US005861572A

United States Patent [19]

Schuermann

[11] Patent Number: 5,861,572

[45] **Date of Patent: *Jan. 19, 1999**

[54] UNIVERSAL SHOTGUN SHELL WAD

[75] Inventor: Heiner Schuermann, Greenville, S.C.

[73] Assignee: Alltrista Corporation, Indianapolis, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 867,104

[22] Filed: Jun. 2, 1997

[51] Int. Cl.[6] ..... F42B 7/08

[52] U.S. Cl. ..... 102/449; 102/532

[58] Field of Search ..... 102/448–463, 102/520–523, 532

[56] References Cited

U.S. PATENT DOCUMENTS

| | | | |
|---|---|---|---|
| 3,164,092 | 1/1965 | Reed et al. | 102/522 |
| 3,299,813 | 1/1967 | Rickey | 102/453 |
| 3,368,489 | 2/1968 | Herter | 102/95 |
| 3,420,178 | 1/1969 | Rempel | 102/95 |
| 3,614,929 | 10/1971 | Herter | 102/43 |
| 3,673,965 | 7/1972 | Herter | 102/95 |
| 3,688,699 | 9/1972 | Horn et al. | 102/42 |
| 3,730,095 | 5/1973 | Lage | 102/42 |
| 4,004,522 | 1/1977 | Furniss et al. | 102/95 |
| 4,103,621 | 8/1978 | Fackler | 102/453 |
| 5,347,932 | 9/1994 | Gardner et al. | 102/451 |

FOREIGN PATENT DOCUMENTS

| | | | |
|---|---|---|---|
| 1045395 | 6/1953 | France | 11/4 |
| 1186659 | 8/1959 | France | 102/449 |
| 353154 | 10/1937 | Italy . | |
| 593153 | 5/1959 | Italy . | |

*Primary Examiner*—Harold J. Tudor
*Attorney, Agent, or Firm*—Brinks Hofer Gilson & Lione

[57] ABSTRACT

The invention provides a universal shotgun shell wad that may be used by manufacturers to assemble a variety of shotgun shells with a wide variety of shot and powder loadings. Shotgun shells of the invention use casings of the type known in the art including a base forming a cavity for a powder primer and an outer wall forming the exterior of the shotgun shell and carrying shotgun shell wad. Such shotgun shells are provided with a shotgun shell wad comprising an outer plug and an inner plug. The outer plug has a bottom shaped to form a powder chamber within the casing of the shotgun shell and a shot-carrying sleeve extending upwardly from the bottom surface and has an inner surface portion with a plurality of engagement surfaces spaced along its length. The inner plug has a closed bottom with at least one engagement surface on its outer periphery shaped for mating with the plurality of engagement surfaces on the inner portion of the outer plug. The variable engagement of the inner plug within the outer plug permit a location of the inner shot plug at variable locations spaced along the inner surface of the outer plug and provide a variable volume for shot within the shotgun shell with the outer plug providing a variable volume for powder within the shell.

11 Claims, 3 Drawing Sheets

UNIVERSAL SHOTGUN SHELL WAD

FIELD OF THE INVENTION

This invention relates to a shotgun shell wad, and more particularly to a universal shotgun wad capable of providing a shotgun shell having a variety of shot and powder loads with a single set of parts.

BACKGROUND OF THE INVENTION

U.S. Pat. No. 3,420,178 discloses a universal shotgun wad including an outer sleeve and a reversible inner sleeve, in which the inner sleeve can provide shotgun shells with two different shot loads. A variety of other shotgun wads have been disclosed in the art, for example, in U.S. Pat. Nos. 3,368,489; 3,614,929; 3,673,965; 3,688,699; 4,004,522 and 5,347,932, and French Patent No. 1,045,395 and Italian Patent Nos. 353,153 and 593,153.

BRIEF SUMMARY OF THE INVENTION

The invention provides a universal shotgun shell wad that may be used by manufacturers to assemble a variety of shotgun shells with a wide variety of shot and powder loadings. Shotgun shells of the invention use casings of the type known in the art, including a base forming a cavity for a powder primer and an outer wall forming the exterior of the shotgun shell and carrying a shotgun shell wad. Such shotgun shells are provided with a shotgun shell wad comprising an outer plug. The outer plug has a bottom shaped to form a powder chamber within the casing of the shotgun shell, and a shot-carrying sleeve extending upwardly from the bottom surface and having an inner surface portion with a plurality of engagement surfaces spaced along its length. The inner shot plug has a closed bottom and at least one engagement surface on its outer periphery shaped for mating with the plurality of engagement surfaces on the inner portion of the shot-carrying sleeve of the outer plug. The variable engagement of the inner plug within the outer plug permits location of the inner shot plug at variable locations spaced along the inner surface of the outer plug and provides a variable volume for shot within the shotgun shell. The outer plug provides a variable volume for powder within the casing. Preferably, the plurality of engagement surfaces of the outer plug comprise a plurality of annular rings formed on the inner surface of the shot-carrying sleeve of the outer plug and the peripheral engagement surface of the inner plug comprises a plurality of annular rings engageable with the annular rings formed on the inner surface of the shot-carrying sleeve. While the engagement surfaces formed on the inner surface of the shot-carrying sleeve and the periphery of the inner plug may have many forms, they are preferably formed as a mating plurality of rings having mating generally triangular cross-sections.

Other features and advantages of the invention will be apparent from the drawings and more detailed description that follow.

DETAILED DESCRIPTION OF THE DRAWINGS

Figure 4:
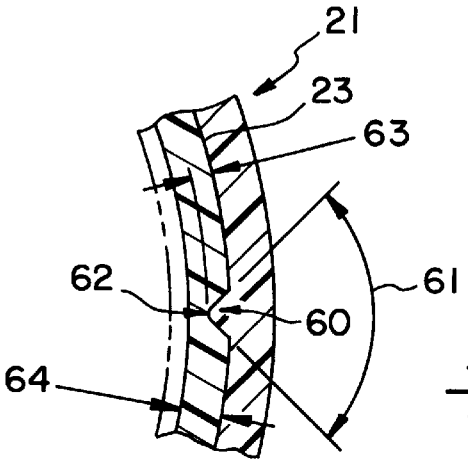
Figure 5:
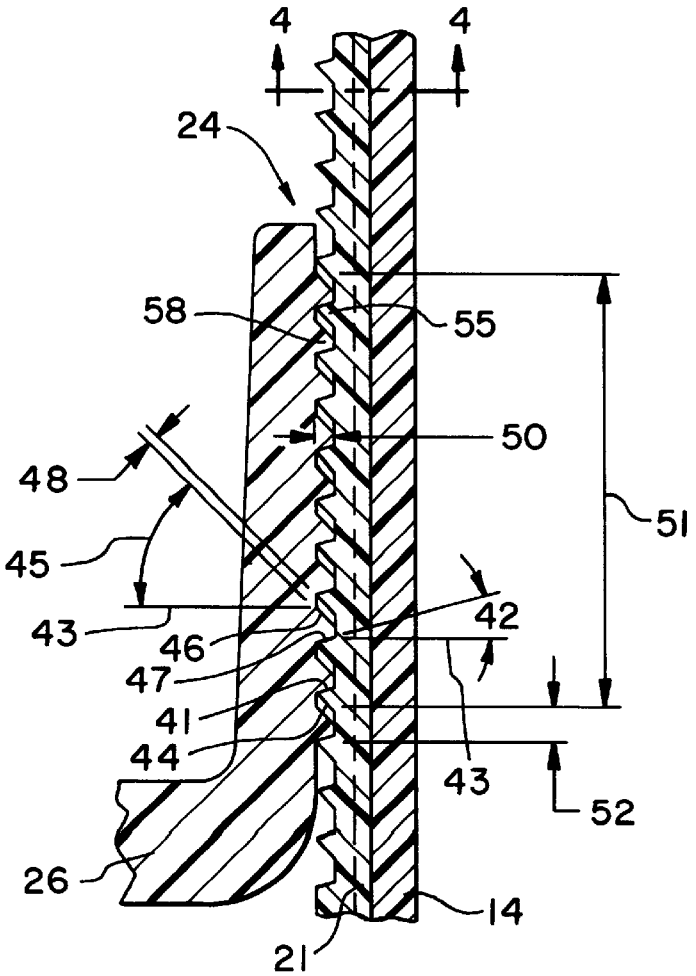

FIG. 4 is an enlarged cross-sectional view of a portion of the shot-carrying sleeve of the outer wad part of a preferred universal shotgun shell wad of the invention, taken at a plane corresponding to line 4—4 of FIG. 5, illustrating the profile of one of a plurality of grooves that can be formed on its outer surface; and FIG. 5 is a cross-sectional view of engaged portions of preferred inner and outer elements of a universal shotgun shell wad of the invention illustrating preferred engagement surfaces.

DETAILED DESCRIPTION OF THE PREFERRED EMBODIMENT

Figure 1:
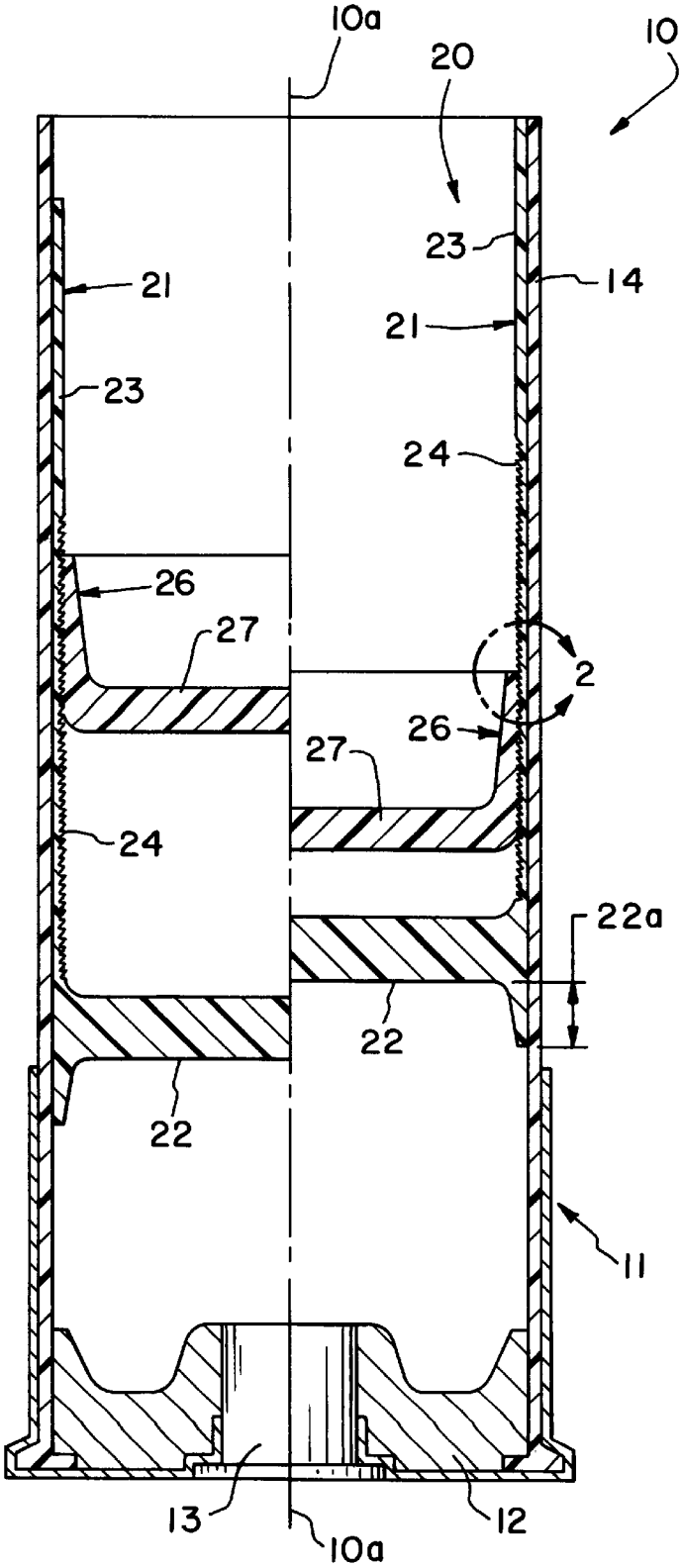
FIG. 1 is a cross-sectional diagrammatic view of an unloaded shotgun shell including a universal shotgun shell wad of the invention, taken at a plane through its central axis, and showing in its left and right halves how the invention provides universal variability in the positions of the shotgun wad parts within a shotgun shell.
Figure 3:
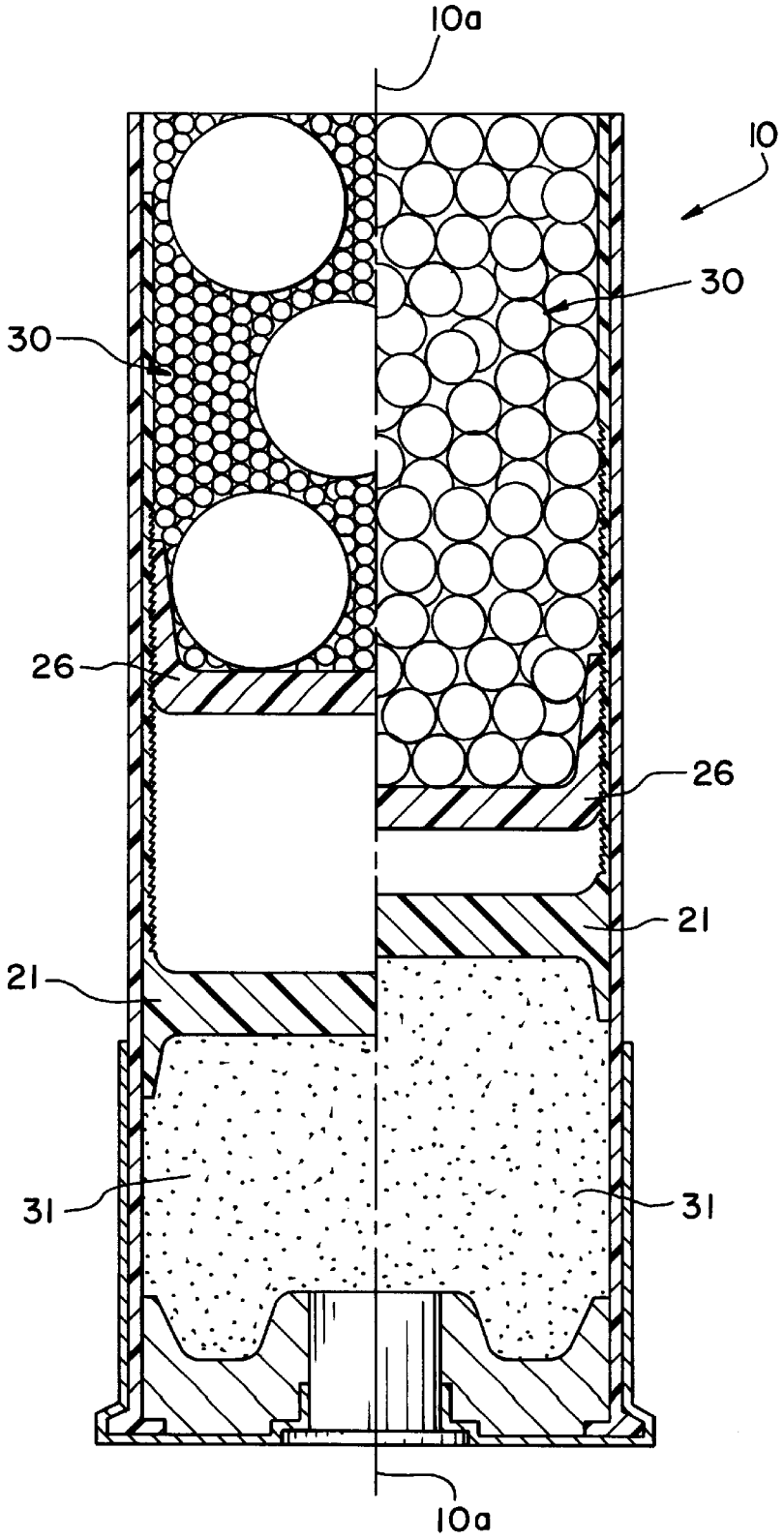
FIG. 3 is a cross-sectional diagrammatic view of a loaded shotgun shell of the invention, taken at a plane through its central axis, and illustrating how the universal shotgun shell wad of the invention provides variable loads of shot and powder in the shell.

FIG. 1 is a cross-sectional diagrammatic view of an unloaded shotgun shell of the invention including universal shotgun wad of the invention. The shotgun shell 10 of FIG. 1 is cylindrical in shape about its central axis 10*a* and the cross-sectional view of FIG. 1 is taken at a plane through the central axis 10*a*. FIG. 1 actually illustrates two of the many variable shotgun shells permitted by the invention and FIG. 3 illustrates how shotgun shell illustrated in FIG. 1 may be variably loaded with shot and powder. The portion of the drawings of FIGS. 1 and 3 left of the central axis 10*a* illustrate how a shotgun shell may be assembled in the invention to provide smaller shot and powder volumes and the portions of FIGS. 1 and 3 right of the center line 10*a* illustrate how the shotgun shells of the invention may be assembled to provide larger shot and powder volumes.

Figure 2:
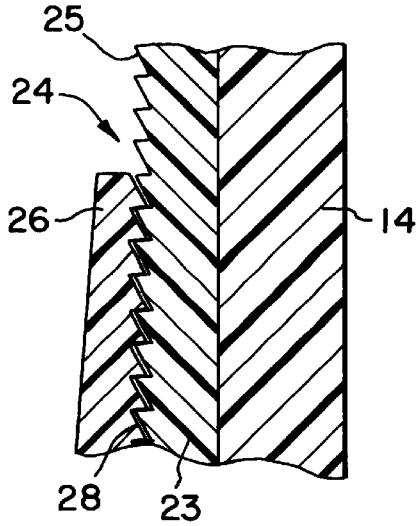
FIG. 2 is a enlarged diagrammatic view of the encircled portion of the cross-section of FIG. 1 to illustrate the engagement surfaces of the wad parts.

As shown in FIG. 1, the shotgun shell 10 includes a casing 11, including a base 12 forming cavity 13 for receipt of a primer for the shell and an outer wall 14 for carrying the shotgun shell wad 20 and the shot and powder loads. As illustrated in FIG. 1, the shotgun shell wad 20 includes an outer plug 21 having a bottom 22 adapted for form with the shell base 13, a powder chamber in the shotgun shell casing 14 (see FIG. 3). The outer plug also includes a shot-carrying sleeve 23 extending upwardly from the bottom surface 22. The shot-carrying sleeve 23 of the outer plug has an inner surface portion 24 shown in dash lines in FIG. 1, forming a plurality of engagement surfaces 25 spaced along its length, as illustrated by the enlarged diagram of FIG. 2 which corresponds to the encircled portion of FIG. 1. As shown in FIG. 2, the engagement surfaces comprise a plurality of projections 25 spaced along the inner surface portion 24 of the outer plug 21. The outer surface of the shot-carrying sleeve 23 is, preferably, provided with a plurality of grooves extending from top to bottom in the outer surface and spaced about its periphery, as more specifically described below with respect to FIG. 4.

The wad also includes an inner shot plug 26, preferably in cup-like form, having a closed bottom 27, and as more clearly illustrated by FIG. 2, at least one engagement surface 28 formed on its outer periphery and shaped for mating with the plurality of engagement surfaces 25 on the inner portion 24 of the outer plug 21. As illustrated by FIG. 1, the mating engagement surfaces 25 of the outer plug and 28 of the inner plug permit location of the inner shot plug 26 at variable locations spaced along the inner surface portion 24 of the outer plug 21, and as illustrated by FIG. 3 permit variable loads of shot 30 and powder 31 within the shotgun shell 10.

As illustrated by FIGS. 2 and 5, the peripheral engagement surfaces of the inner plug 26 preferably comprise a plurality of annular rings engageable with the plurality of annular rings formed on the inner surface of the shot-carrying sleeve 23, and each of the plurality of rings preferably forms complimentary projecting surfaces having triangular cross-section portions that mate in their variable engagement. As noted above, although the preferred embodiments include complimentary and engaging annular rings with mating triangular-shaped cross-sections, the engagement surfaces may have other forms in the invention. For example, the inner surface 24 of the outer plug 21 may be provided with a plurality of projecting nibs or latch-like projections from the inside surface of the shot-carrying sleeve 23 at spaced locations along the longitudinal axis of the outer plug, and the inner plug 26 can be provided with one or more annular indentations permitting engagement with the nibs at variable locations along the length of the shot-carrying sleeve 23 of the peripheral outer plug 21. In an alternative arrangement, the outer surface of the inner plug 26 may be provided with projecting nibs, and the inside surface of the shot-carrying sleeve 23 of the outer plug 21 provided with a plurality of indentations permitting engagement of the peripheral nibs of the inner plug 26 in the indented portions of the inner surface of the shot-carrying sleeve 23 at variable locations along the length of the outer plug 21. In still further alternative but less flexible arrangement, the inside surface shot-carrying sleeve 23 of the outer plug 21 may be provided with a plurality of spaced nibs along its length longitudinally, with the spacing between adjacent nibs along the length of the inside surface being such as to engage the upper and lower surfaces of the inner plug 26 and hold it in a plurality of positions between adjacent nibs of the series of spaced nibs provided on the outer plug. These and other alternative embodiments of engagement surfaces can be used in the invention.

FIG. 5 is a drawing showing a preferred form of engagement surfaces for wads of the invention. FIG. 5 is a cross-sectional view corresponding to FIG. 2, but showing in greater detail one form of preferred engagement surfaces. As previously described, the preferred engagement surfaces include a plurality of rings formed on and spaced along a portion 24 of the inner surface of the outer part 21 of the wad. As indicated earlier, the plurality of rings are formed to provide sawtooth projecting engagement surface portions.

More specifically, the inner sawtooth projecting engagement surfaces 55 of the outer part 21 comprise in cross-section, a series of triangular projections having upper surfaces 41 laying at angles 42 of about 15 degrees with respect to planes 43 orthogonal to the central axis 10*a* of the outer part 21, and have lower surfaces 44 lying at angles 45 of about 45 degrees with respect to planes 43 orthogonal to the central axis of the outer port 21. In preferred wads, the triangular projections so formed have heights 50 of about 0.010 inch and are spaced at intervals 52 of about 0.030 inch along a portion 24 of the outer part 21.

The outer engagement surfaces of the inner part 26 preferably comprise, as shown in FIG. 5, a series of trapezoidal projections 58 having upper surfaces 46 lying at angles of about 45 degrees with respect to planes 43 orthogonal to the central axis 10*a* of the inner part 26, and have lower surfaces 47 lying at angles of about 15 degrees with respect to planes 43 orthogonal to the central axis 10*a* of the inner part. The heights 50 of the trapezoidal projections are about 0.010 inch, and the spacing between their upper surfaces 46 and lower surfaces 47 provides a spacing 48 of about 0.005 inch between the upper surfaces 46 of the trapezoidal projections of the inner part 26 and the lower surfaces 44 of the triangular projections of the outer part 21 when the parts are engaged.

As shown in FIG. 5, the plurality of annular engagement rings of the inner part 26 can preferably comprise about 10 rings 58 spaced over a distance 51 of about 0.300 inch, and in preferred embodiments of the wad, the plurality of engagement rings 55 of the outer part 21 are formed and spaced along a portion 24 of the inner surface of the shot-carrying sleeve 23, preferably beginning at a distance of about 0.300 inch below its upper surface and extending downwardly along the inner surface to a fraction of an inch above its bottom surface 22 (see FIG. 1).

FIG. 4 is a cross-sectional view of the shot bearing sleeve 23 of the outer part 21 illustrating a profile of one of a plurality of grooves 60 spaced about its outer surface. In the preferable wad of this invention, each of the grooves is generally V-shaped as shown in FIG. 4 with an included angle 61 of about 90 degrees, although included angles from about 60 degrees to about 120 degrees are also satisfactory. The grooves 60 are generally formed with a rounded filet 62 at its inside having a radius of about 0.005 inch for example. The grooves 60 have a depth 63 equal to about one-half the thickness 64 of the shot-carrying sleeve 73 of the outer part 21. In preferred embodiments such grooves may be spaced at 90 degree intervals about the periphery of the outer part 21.

Wads of the invention are preferably molded from thermoplastic resins providing surfaces with a reasonable degree of lubricity and having and providing reasonable resilience but sufficient rigidity in thicknesses on the order of about 0.02 inch to about 0.03 inch that they may be easily assembled by assembly line workers into a reliable assembly. Such materials include preferably high density polyethylene and polypropylene, but those skilled in the art will recognize that the other thermoplastic and thermosetting resins may be conveniently and inexpensively used in injection molding to form parts for wads of the invention.

In one example of a universal shotgun shell wad of the invention in 12-gauge size, the total height of the outer part 21 can be about 1.8 inch and the bottom surface 22 can be concavely formed providing a relatively shallow concavity with a concavity depth 22*a* (illustrated in FIG. 1) of about 0.17 inch. The cylindrical shot-carrying sleeve 23 can have a thickness of about 0.023 inch and the bottom partition 22 can have a thickness of about 0.100 inch. The cup-like inner part 26 can have an overall height of about 0.35 inch, a sidewall portion having a thickness of about 0.030 inch and a bottom 27 having a thickness of about 0.04 inch. The engagement surfaces in the exemplary 12-gauge wad can be the same as those illustrated in FIG. 5 and described as preferred in the invention.

While a preferred embodiment of the invention has been illustrated and described above, those skilled in the art will recognize that the invention can be incorporated in other embodiments and forms and should be defined and limited only by the claims that follow.

I claim:

1. A shotgun shell, comprising a casing including a base forming a cavity for a primer and an outer wall for carrying a shotgun shell wad; and a shotgun shell wad comprising an inner plug and an outer plug, said outer plug having a bottom surface forming a powder chamber in the shotgun shell casing, and a shot-carrying sleeve extending upwardly from the bottom surface, said shot-carrying sleeve having an inner surface portion provided with a plurality of engagement surfaces at spacings of about 0.030 inches and extending uniformly along more than one-half of the length of the inner surface portion, and an inner plug having a closed bottom with at least one engagement surface on its outer periphery shaped for mating with the plurality of engagement surfaces at spacings of about 0.030 inches on the inner surface portion of the shot-carrying sleeve, engagement of said engagement surfaces of said outer plug and said at least one engagement surface of said inner plug holding said inner plug in a selected location within said outer plug and permitting variation in the location of the inner plug at spacings of about 0.030 inch along more than one-half of the length of the inner surface portion of the shot-carrying sleeve, said variation in location of the inner plug within the outer plug providing a variable volume for shot within the shotgun shell and said outer plug, with said casing, providing a variable volume for powder within said casing.

2. The shotgun shell of claim 1 wherein said plurality of engagement surfaces of the outer plug comprise a plurality of annular rings with a saw-toothed cross-sections formed on the inner surface of the shot-carrying sleeve.

3. The shotgun shell of claim 2 wherein the at least one peripheral engagement surface of the inner plug comprises a plurality of annular rings at spacings of about 0.030 inches engageable with said annular rings formed along the inner surface portion of the shot-carrying sleeve.

4. The shotgun shell of claim 1 wherein the plurality of engagement surfaces comprises a plurality of rings, each ring having a triangular cross-section, and wherein the at least one engagement surface of said inner shot plug comprises a plurality of rings having triangular cross-section portions complementary to and engaging the triangular cross-section rings of the outer plug, and wherein the outer surface of the shot-carrying sleeve is formed with a plurality of longitudinally extending grooves.

5. An injection molded universal shotgun shell wad, comprising an outer part formed with a cylindrical outer surface including a plurality of grooves spaced about the outer surface and extending longitudinally from its top to its bottom, a cylindrical inner surface including a plurality of rings spaced along an inner surface portion and providing saw-toothed projecting engagement surfaces, and a partition spaced above the bottom of the outer part to provide a powder retaining surface, and an inner part formed with a cup-shaped inside surface and an outer surface including a plurality of mating saw-toothed engagement surfaces, said mating saw-toothed engagement surfaces of said outer surface of said inner part permitting an adjustable engagement of the inner part within the outer part at varying locations by mating with said saw-toothed projecting engagement surfaces along said inner surface portion of said outer part, providing a variable volume shot containing wad.

6. The wad of claim 5 wherein the grooves of the plurality of longitudinal grooves are V-shaped with an included angle of from about 30 degrees to about 60 degrees and have a depth of from about 30 to about 60 percent of the thickness between the outer and inner cylindrical surfaces of the outer part.

7. The wad of claim 6 wherein the plurality of grooves comprise four grooves spaced 90 degrees apart and are formed with an included angle of about 90 degrees and a depth about one-half of the thickness between the inner and outer cylindrical surfaces.

8. The wad of claim 5 wherein the plurality of rings spaced along the inner surface of the outer part comprise substantially more than 10 rings, and said saw-tooth projecting engagement surfaces of the outer part comprise, in cross-section, a series of triangular projections having upper surfaces lying at angles of about 15 degrees with respect to planes orthogonal to the central axis of the outer part and lower surfaces lying at angles of about 45 degrees with respect to planes orthogonal to the central axis of the outer part, said triangular projections having a height of about 0.010 inch with a spacing of about 0.030 inch.

9. The wad of claim 8 wherein the plurality of mating saw-toothed engagement surfaces of the inner part comprise about 10 rings and said mating saw-toothed engagement surfaces of the inner part comprise a series of trapezoidal projections having upper surfaces lying at angles of about 45 degrees with respect to planes orthogonal to the central axis of the inner part, and lower surfaces lying at angles of about 15 degrees with respect to planes orthogonal to the central axis of the inner part, the heights of the trapezoidal projections being about 0.010 inch and the spacings between the upper and lower surfaces providing a clearance of about 0.005 inch between the upper surfaces of the trapezoidal projections and the lower surfaces of the triangular projections of the outer part when the parts are engaged.

10. A universal shotgun wad, comprising an outer plug having a bottom surface forming a powder chamber in a shotgun shell cartridge and a shot-carrying sleeve extending upwardly from the bottom surface, said shot-carrying sleeve having an inner surface portion with a plurality of annular rings with projecting engagement surfaces formed on the inner surface portion and extending uniformly along its length and having an outer surface portion formed with a plurality of longitudinally extending grooves, and an inner shot plug having a closed bottom with a plurality of annular rings on its outer periphery shaped for mating with the plurality of annular rings on the inner surface portion of the outer plug, engagement of said annular rings of said outer plug and inner plug retaining said inner plug in a selected location permitting variation in the location of the inner shot plug along the inner surface portion of the outer plug.

11. The universal shotgun wad of claim 10 wherein the annular rings of the outer plug and the inner shot plug have a triangular cross-section.

* * * * *